US007645197B2

(12) United States Patent
Hicks

(10) Patent No.: US 7,645,197 B2
(45) Date of Patent: Jan. 12, 2010

(54) GOLF PRACTICE SYSTEM

(76) Inventor: Jay Hicks, c/o The Moore Law Firm, 4578 E. Camp Lowell Dr., Tucson, AZ (US) 85712

( * ) Notice: Subject to any disclaimer, the term of this patent is extended or adjusted under 35 U.S.C. 154(b) by 0 days.

(21) Appl. No.: 11/741,486

(22) Filed: Apr. 27, 2007

(65) Prior Publication Data

US 2008/0268973 A1 Oct. 30, 2008

(51) Int. Cl.
*A63B 69/36* (2006.01)

(52) U.S. Cl. ..... 473/166; 473/172; 473/194

(58) Field of Classification Search ..... 473/168–170, 473/172, 191, 194, 166, 163, 182–184; 124/6
See application file for complete search history.

(56) References Cited

U.S. PATENT DOCUMENTS

| | | | | |
|---|---|---|---|---|
| 1,540,350 | A * | 6/1925 | Longenecker | 473/158 |
| 1,745,201 | A * | 1/1930 | Alston | 473/166 |
| 3,202,429 | A * | 8/1965 | Richman | 473/194 |
| 4,215,865 | A * | 8/1980 | Pilati | 473/153 |
| 4,556,219 | A | 12/1985 | Tillery | |
| 4,703,931 | A | 11/1987 | Steen | |
| 5,417,196 | A * | 5/1995 | Morrison et al. | 124/6 |
| 7,207,893 | B1 * | 4/2007 | Louie | 473/166 |
| 7,278,934 | B2 * | 10/2007 | McBride et al. | 473/451 |
| 2005/0209027 | A1 * | 9/2005 | Joseph | 473/431 |

* cited by examiner

*Primary Examiner*—Mark S Graham
(74) *Attorney, Agent, or Firm*—Quarles & Brady LLP; Gavin J. Milczarek-Desai

(57) ABSTRACT

A golf practice system including a containment structure and a mechanically driven golf ball-return unit coupled to the containment structure, with a sloped portion or channel directing a struck golf ball to the return unit such that the golf ball is mechanically projected back to the golfer. A berm device for chipping practice and other uses also is disclosed.

16 Claims, 2 Drawing Sheets

GOLF PRACTICE SYSTEM

BACKGROUND OF THE INVENTION

1. Field of the Invention

The invention generally relates to a recreational system that includes a containment member and golf ball-return unit that is especially useful for providing a portable practice area for golfers.

2. Description of the Related Art

Driving ranges exist to provide an area in which participants may practice hitting a golf ball without the use of actual golf coarse space. Such driving ranges typically consist of a space that is bounded by nets to safely stop a struck golf ball and may include targets or other features designed to provide feedback to a golfer. While useful for their intended purpose, driving ranges are large, fixed facilities that a user must be transported to and share with other users.

Hitting actual golf balls in a practice session is essential for learning to develop a sound golf swing and playing the game of golf well. Most importantly, it is highly desirable that a golfer develop a good swing by simulating play and practicing a variety of shots, including driving, chipping, putting, and the like.

There is simply no substitute for hitting real golf balls. A primary reason that a golfer goes to an outdoor driving range is to practice his or her swing mechanics and follow through. However, in addition to the time consumed and cost expended to get to and use a driving range, often the range only facilitates a tee drive. In other words, chipping, putting, or other shots are either not permitted or not practical to practice because the driving range provides only yardage markers or distant and fixed targets. Thus, the golfer could greatly benefit from a device that provides the benefit of hitting real golf balls in a timely manner by having a practice system located at his/her residence, that allows one to practice a variety of golf swings/shots, that realizes significant cost savings by requiring only one or a few golf balls (versus paying for a bucket of golf balls over and over), and that obviates the need to retrieve the balls by providing an automatic ball return coupled to the practice system containment area.

Many inventors have created golf practice nets. None of these devices are known to both provide the golfer sufficient flexibility in the type of swing or shot practiced (e.g., putting, driving, chipping) and to provide an automated ball return function, among other features. Moreover, electronic devices such as lighted sticks, projecting beam clubs, and floor mounted sensors can predict the path of the ball by sensing the club head speed and orientation at impact but usually are expensive or require a relatively large range located indoors. Of course, electronic practice methods also can be very unnatural and may not offer the benefits of striking a real golf ball.

The related art does teach various golf ball driving practice and training devices comprised of a frame structure and receiving netting to serve as a means whereby golfers may conveniently and easily practice driving golf balls in a small area. For example, the following U.S. patents disclose various types of devices which utilize a containment area for safely arresting golf balls.

Tillery, U.S. Pat. No. 4,556,219, discloses a typical cage-type driving range that offers the ability to practice a diving swing but not putting or chipping from variable distances. Moreover, Tillery's device relies on gravity to return the ball to a user at a fixed location. The invention of this patent also appears to be not easily relocated.

Steen, U.S. Pat. No. 4,703,931, is typical of many practice nets. While not solely intended for golf, it embodies basic principles of netting and rigid frame. Again, only driving and perhaps some chip shots can be practiced, with no mechanical ball-return means provided.

Hence, it continues to be desirable to have a golf practice system that improves upon the foregoing and related art.

SUMMARY OF THE INVENTION

The invention relates in general to a recreational system that includes a containment member and mechanized ball-return unit. The containment member may include a net or flexible material that acts to dissipate the kinetic energy of a ball that comes into contact therewith. Moreover, the invention can include a variety of unique and useful features, such as a berm "obstacle" and a ball-return unit that projects a ball a variable distance back to a user. Preferably, the embodiments of the invention are portable and easily assembled/disassembled.

In one embodiment of the invention, a golf practice apparatus is provided that includes a containment member adapted to contain an incoming golf ball within a defined area and a mechanically driven golf ball-return unit coupled to the containment member. The containment member includes a sloped portion (such as a ramp or a channel) that directs a golf ball hit into the containment area to the return unit so that the golf ball is mechanically projected back to a user. Thus, the golfer does not have to purchase a large plurality of balls and avoids the need to retrieve each ball after it is struck.

In some embodiments, the containment member is made to cause a golf ball to drop substantially vertically upon striking an interior surface of the containment member. For example, heavy canvass and other materials are know to provide such an effect. Thus, a channel disposed about a periphery of the containment area can receive a vertically falling golf ball and direct it to the ball-return unit.

In another embodiment of the invention, the golf practice apparatus includes a berm disposed in front of a golf ball-return unit. In this embodiment, the golf ball-return unit preferably is adapted to eject a golf ball over the berm.

In yet another embodiment of the invention, a portable containment member is provided that is connected to a mechanically driven golf ball-return unit via a sloped ramp located at the bottom of the containment member.

Additional features and advantages of the invention will be forthcoming from the following detailed description of certain specific embodiments when read in conjunction with the accompanying drawings.

DESCRIPTION OF THE PREFERRED EMBODIMENTS

Figure 1:
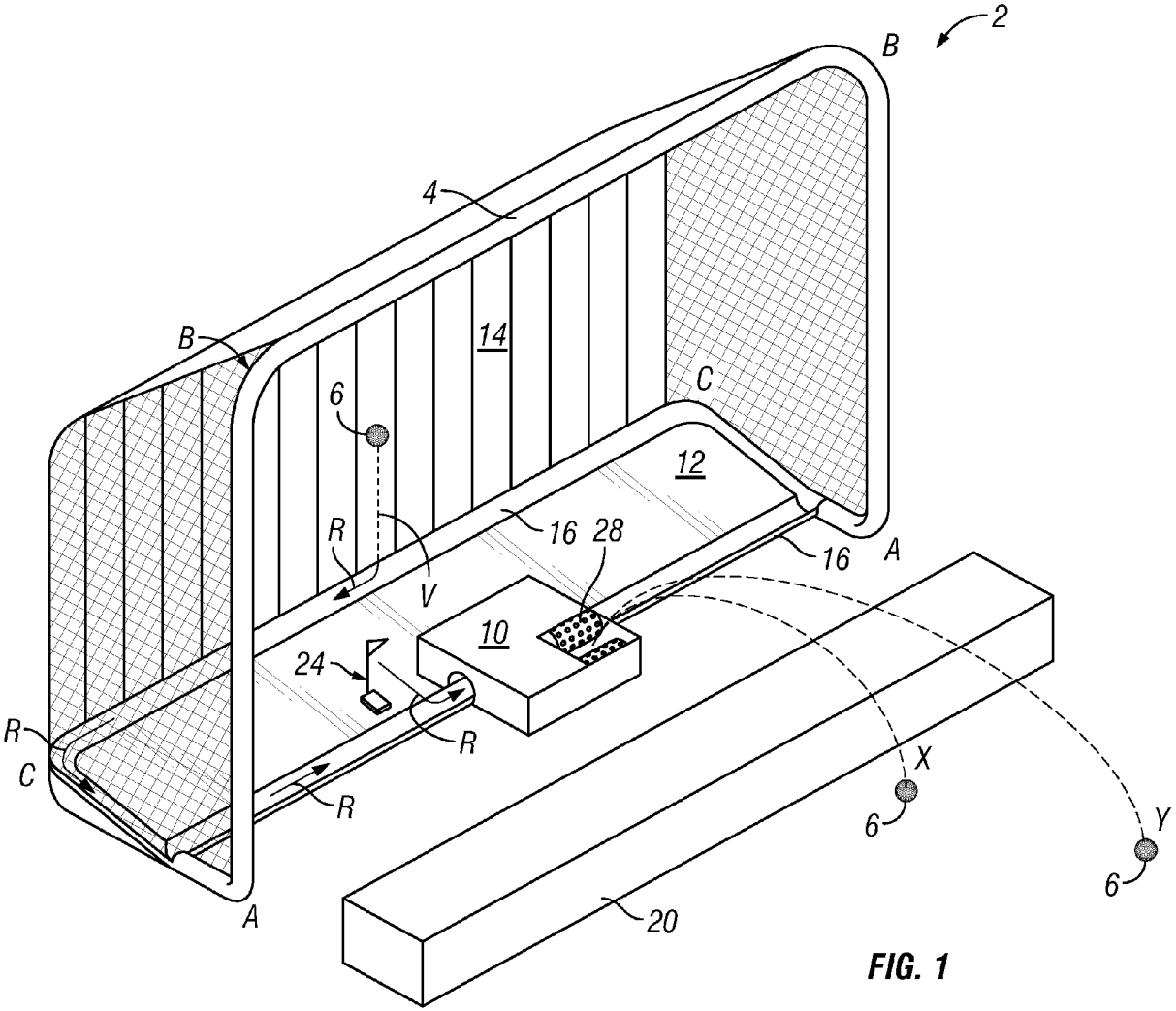
FIG. 1 is a perspective view of a first embodiment of the invention.

Referring to FIG. 1, the numeral 2 generally identifies a golf practice apparatus of the invention. The apparatus 2 includes a containment member 4 adapted to contain an incoming golf ball 6 within a defined area (in this case, the area defined by A, B, C). A mechanically driven golf ball-return unit 10 is coupled to containment member 4 via sloped floor or ramp 12 that directs a golf ball 6 to return unit 10 so that the golf ball can be mechanically projected back to the apparatus user.

Preferably, the golf ball-return unit 10 is adapted to project the golf ball 6 a variable distance (as symbolized by dotted lines X, Y). Accordingly, a user may strike a golf ball from a variety of distances and/or on a variety of playing surfaces.

Returning to FIG. 1, the containment member 4 in this embodiment further includes a material 14 adapted to cause a golf ball 6 to drop substantially vertically (as symbolized by dotted arrow V). Thus, golf ball 6 can descend into a ball channel 16 disposed about a bottom periphery of the containment member 4. Alternatively, the ball 6 may fall to the ramp 12. In either case, the ball 6 is directed to ball-return unit 10 due to the slope of the channel 16 or ramp 12 (with the direction of the ball to the return unit being symbolized by arrows R).

The apparatus 2 may further include a berm 20 disposed in front of the golf ball-return unit 10. The function of the berm is mainly two-fold. First, it provides a protective barrier that prevents a low "line drive" from damaging the ball return unit 10 or "ricocheting" off the ramp 12 or channel 16 of the containment unit 4. Second, the berm simulates a golfing situation in which a ball must be shot with a trajectory that "clears" a certain obstacle. Thus, it forces the golfer to "chip" over the berm so as to simulate, for example, clearing a hazard or shooting out of a bunker or trap. In this regard, the berm 20 may be of a variety of lengths, shapes and heights depending on the desired effect.

In addition to practicing driving and chipping, a user can also practice putting. To simulate putting on an upslope, a "hole" may be disposed on ramp 12 of the containment member such as flag 24. Preferably, when flag 24 is struck by the putted ball, the flag moves or falls over so that a user can easily discern an accurate shot. The flag 24 also may be disposed on adjacent to or inside the portion of the channel 16 the feeds directly into return unit 10 so that putting on a flat surface may be practiced (i.e., the ball simply enters the channel 16 and hits the flag, which stops its momentum so that the ball can feed into return unit 10).

When a golfer practices with a berm 20, preferably the ball-return unit 10 is adapted to eject a golf ball 6 over the berm. In one embodiment of the invention, the "adaptation" includes varying the speed of a pair of roller members 28 disposed inside the return unit 10 such that the ball is projected upwardly along a desired trajectory (described in more detail in below and show in FIGS. 3 and 4).

Figure 2:
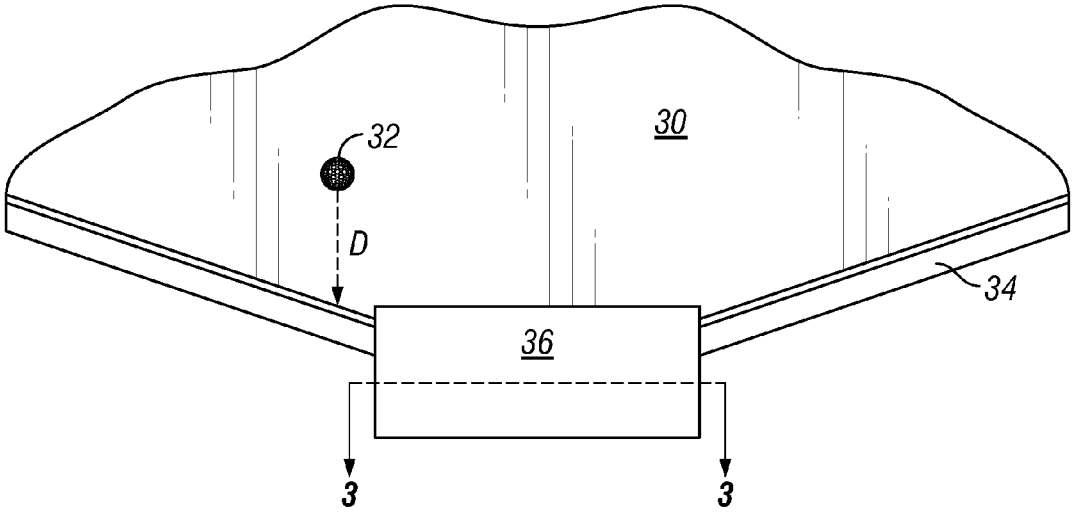
FIG. 2 is partial front view of a second embodiment of the invention.

Turning to FIG. 2, a second embodiment of the invention is illustrated. This embodiment includes a planer containment member 30 that is adapted to cause a golf ball 32 to drop substantially vertically (arrow D) upon striking the interior surface (i.e., the surface facing the golfer) of planer containment member. Preferably, member 30 is made from a shock-absorbing material that is capable of absorbing the kinetic energy of the ball 32 such that it drops substantially vertically upon string member 30. Disposed about the bottom periphery of the containment member 30 is a sloped ball channel 34, which directs ball 32 to ball-return unit 36 so that it may be projected back to the golfer.

Figure 3:
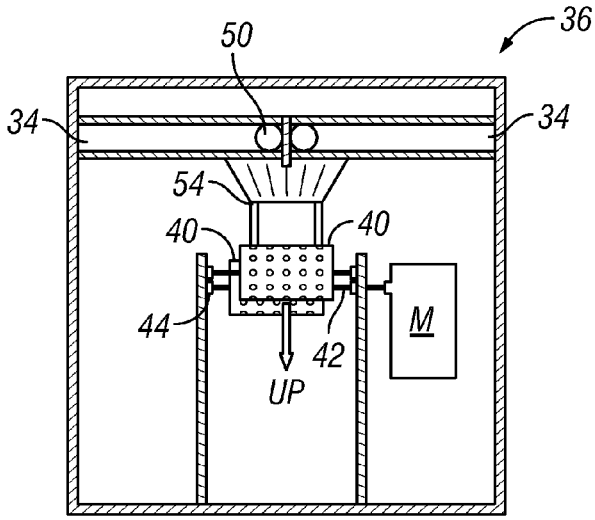
FIG. 3 is a cross-sectional view of the ball-return unit illustrated in FIG. 2 as taken along dotted line 3-3 and viewed in the direction of the arrows.

As illustrated in cross-sectional view in FIG. 3, one preferred embodiment of the ball-return unit 36 includes a pair of roller members 40 adapted to eject a golf ball in a curved trajectory. Each roller 40 is mounted on an axle 42 the is either coupled to a bearing 44 or a motor M. In this embodiment, the motor M rotates one roller 40 while the other roller is free spinning. Hence, a ball 32 that is directed into return unit 36 via channel 34 falls through opening 50 into hopper 54, which then feed the ball to the pair of rollers 40. As the ball passes through the rollers, it is projected upwardly out of the return unit.

Figure 4:
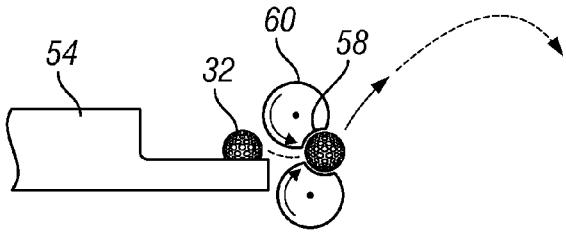
FIG. 4 is a simplified schematic side-view of the ball return mechanism shown in FIG. 3.

FIG. 4 depicts in a simplified schematic view that a preferred feature of the roller members 40 is their being disposed with a deformably resilient material 58 (such as pliable rubber) on a ball-contact surface 60. Thus, the deformably resilient material 58 "grabs" a ball 32, conforms to the ball's shape, and assumes its original roller conformation upon release of the ball.

Various modifications are possible within the meaning and range of equivalence of the appended claims.

I claim:

1. A golf practice apparatus, comprising a containment member being adapted to contain an incoming golf ball within an area defined by said member; and a mechanically driven golf ball-return unit having a top and sides coupled to said containment member, wherein said containment member includes a sloped portion that directs said incoming golf ball to said return unit through a ball channel disposed around a bottom periphery of the containment member and extending perpendicularly to a side of said return unit such that the golf ball is introduced into the return unit through said side and mechanically projected back to a user.

2. The apparatus of claim 1, wherein the golf ball-return unit is adapted to project the golf ball a variable distance.

3. The apparatus of claim 1, wherein said containment member is adapted to cause a golf ball to drop substantially vertically upon striking an interior surface of said containment member.

4. The apparatus of claim 1, further including a berm disposed in front of said golf ball-return unit.

5. The apparatus of claim 4, wherein said golf ball-return unit is adapted to project said golf ball over said berm.

6. The apparatus of claim 5, wherein said golf ball-return unit is adapted to project said golf ball a variable distance over said berm.

7. The apparatus of claim 1, wherein said golf ball-return unit comprises a pair of roller members adapted to project said golf ball in a curved trajectory.

8. The apparatus of claim 7, wherein said roller members comprise a deformably resilient material on a ball-contact surface of said roller members.

9. A golf practice apparatus, comprising a portable containment member being adapted to contain an incoming golf ball within an area defined by said member; and a mechanically driven golf ball-return unit having a top and sides connected to said containment member, wherein said containment member includes a sloped portion that directs said incoming golf ball to said return unit through one of at least two ball channels, said ball channels being disposed around a bottom periphery of the containment member and extending perpendicularly to opposing sides of said return unit such that the golf ball is introduced into the return unit through one of said opposing sides and mechanically projected back to a user.

10. The apparatus of claim 9, wherein the golf ball-return unit is adapted to return the golf ball a variable distance.

11. The apparatus of claim 9, wherein said containment member is adapted to cause a golf ball to drop substantially vertically upon striking an interior surface of said containment member.

12. The apparatus of claim 9, further including a berm disposed in front of said golf ball-return unit.

13. The apparatus of claim 12, wherein said golf ball-return unit is adapted to project said golf ball over said berm.

14. The apparatus of claim 13, wherein said golf ball-return unit is adapted to project said golf ball a variable distance over said berm.

15. apparatus of claim 9, wherein said golf ball-return unit comprises a pair of roller members adapted to project said golf ball in a curved trajectory.

16. The apparatus of claim 15, wherein said roller members comprise a deformably resilient material on a ball-contact surface of said roller members.

* * * * *